United States Patent [19]

Manizza et al.

[11] 4,308,985

[45] Jan. 5, 1982

[54] TRAY CONTAINER WITH REINFORCED SIDEWALLS

[75] Inventors: Guelfo A. Manizza, Blauvelt, N.Y.; William M. Brown, Darien, Conn.

[73] Assignee: Federal Paper Board Company, Inc., Montvale, N.J.

[21] Appl. No.: 148,908

[22] Filed: May 12, 1980

[51] Int. Cl.[3] ..... B65D 5/26

[52] U.S. Cl. ..... 229/31 R

[58] Field of Search ..... 229/31 R

[56] References Cited

U.S. PATENT DOCUMENTS

| | | | |
|---|---|---|---|
| 3,565,324 | 2/1971 | Odenhagen | 229/31 R |
| 3,701,467 | 10/1972 | Johansson | 229/31 R |
| 3,904,104 | 9/1975 | Kane | 229/31 R X |
| 3,917,155 | 11/1975 | Bemiss | 229/31 R |
| 4,019,675 | 4/1977 | Andersson et al. | 229/31 R |
| 4,042,165 | 8/1977 | Elder | 229/DIG. 4 X |
| 4,114,797 | 9/1978 | Manizza | 229/31 R |
| 4,130,236 | 12/1978 | Manizza | 229/31 R |

*Primary Examiner*—Herbert F. Ross
*Attorney, Agent, or Firm*—Guy A. Greenawalt

[57] ABSTRACT

A tray-type container for processing and marketing a loaf of bread, or the like, and a method of forming the same is disclosed, which tray is formed from a single blank of paperboard having a coating of a heat sealable and heat resistant film material so as to provide, when fully set-up, a rectangular bottom wall with hingedly connected upstanding sidewalls integrally connected at the corners by pairs of triangular web members folded upon each other and against the outside faces of opposite sidewalls where they are secured in reinforcing relation by narrow top edge flanges folded into underlying relation with and sealed to narrow flanges at the top edge of the sidewalls with the film material being skip-cut at the top edge of the sidewalls so as to reduce buckling in the sidewalls which otherwise results due to the difference in shrinkage of the film and the paperboard material.

6 Claims, 6 Drawing Figures

GRAIN

TRAY CONTAINER WITH REINFORCED SIDEWALLS

BACKGROUND OF THE INVENTION

This invention relates to containers and is more particularly concerned with improvements in product containers which are in the form of a tray and which are adapted to be fabricated from paperboard or similar foldable sheet material of a character which will enable the container to be used for baking bread, or the like, and marketing the product in the tray in which it has been baked.

Tray containers have been developed heretofore which are particularly adapted for use in the bakery industry where the product may be processed in an oven and subsequently marketed without removing it from the container in which it has been processed. Products such as cakes, pastry, and the like are generally in a flowable state initially, that is, in a liquid or semi-liquid condition, and it is a requirement that the container be leakproof when filled to a predetermined level with the product and capable of withstanding oven temperatures during the baking process without damage from the heat so that the baked product may be marketed without removal from the container. For such products, containers have been developed which are adapted to be formed from thin metal foil or relatively stiff metallic sheet material which can be pressed or shaped to the desired form and become part of the final package in which the product is marketed. Such containers are generally expensive and lacking in esthetic appear since they do not readily accept the inks commonly employed in decorative printing. Efforts have been made, with some degree of success, to provide non-metallic trays which are suitable for this purpose. One such tray structure is disclosed in U.S. Pat. No. 4,114,797 granted Sept. 19, 1978. Trays of this type, which are formed from paperboard having a film-like heat resistant coating, have not been entirely satisfactory for handling some bakery products, such as bread, where a rectangular shape is desired so that the finished product will have the conventional rectangular shape of a loaf of bread. The plastic film employed for trays of this type generally has shrink characteristics which differ from paperboard with the result that the sidewalls buckle and have an unattractive appearance.

Consequently, there appears to be a need for trays of this type which have greater rigidity or stiffness, particularly in the sidewall panels so as to more nearly retain their shape during processing and which may be employed for processing in a microwave oven as well as in a conventional convection oven.

It is a general object, therefore, of the present invention to provide an improved open top tray structure of the type described which has greater rigidity in the sidewalls, which is more versatile in use, and more economical so as to compete with trays formed of metal foil, and the like.

It is a more specific object of the invention to provide an improved tray structure and a method of forming the same in which the tray is fabricated from a paperboard blank coated with a film forming heat resistant plastic material which is cut and scored, so that it can be set-up with sidewall panels upstanding from a rectangular bottom wall panel and connected at the corners by pairs of integral web members which are folded upon each other and against the outside faces of oppositely disposed sidewalls having narrow top flanges for reinforcing the sidewalls and with provision for anchoring the folded web members in position and having overlapping tab members forming corner connections between the top edge flanges.

It is a further object of the invention to provide a tray structure of the type described and a method of fabricating the same so as to provide integrally hinged top flange forming strip members on the sidewalls, with cut scoring at the hinge connection between the sidewalls and the top flanges which will prevent the difference in the contraction and expansion characteristics of the plastic film and the paperboard from buckling the sidewalls during processing of the tray and product in a baking oven.

The herein disclosed and claimed invention comprises a tray structure and a method of forming the same from a cut and scored blank of foldable paperboard which is coated with a heat resistant plastic film, which tray comprises a bottom wall forming panel and oppositely disposed pairs of peripheral sidewall forming panels which are integrally hinged to and disposed in upstanding relation with the bottom wall forming panel, with pairs of integrally hinged triangular web members at the intersecting corners, which web members are folded into overlying relation on the outside face of oppositely disposed sidewall panels and secured in position by means of a top edge flange formation adhesively adhered beneath an edge reinforcing strip in the form of a flange which is integrally hinged to the top edge of the associated sidewall forming panel on a hinge line defined by cut-scores in which the plastic film is severed by closely spaced small length cuts.

DESCRIPTION OF THE PREFERRED EMBODIMENT OF THE INVENTION

Figures 5, 6:
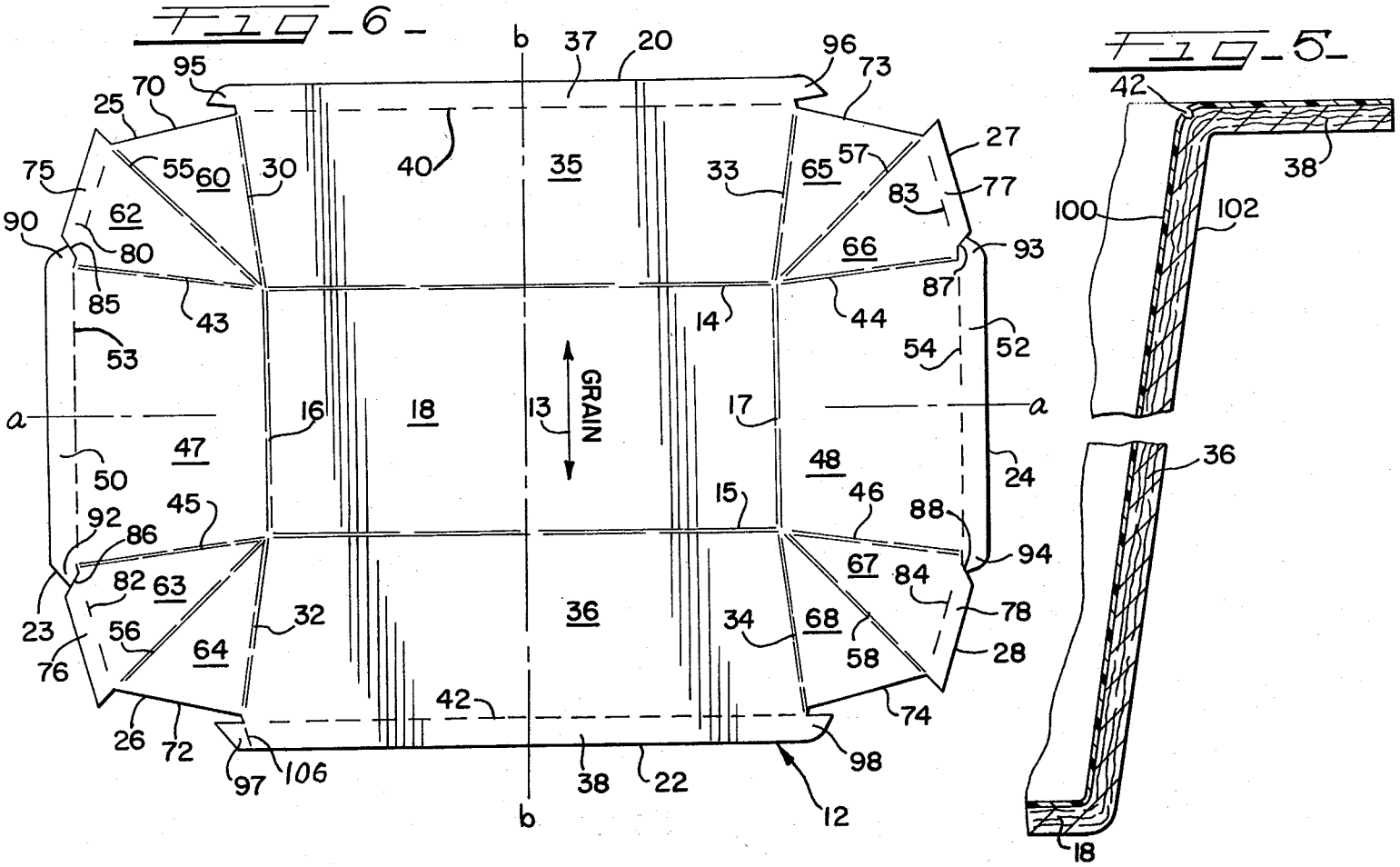
FIG. 5 is a fragmentary cross-sectional view taken on the line 5—5 of FIG. 2, to a greatly enlarged scale and with portions broken away.
FIG. 6 is a plan view, showing the inside face of a blank which is cut and scored preparatory to the forming of the tray shown in FIG. 1.

Referring to the drawings, there is illustrated a tray-type container or carton 10 which is adapted for use in the preparation and marketing of bakery products, particularly, bread, the tray structure being fabricated from a single sheet of flexible paperboard material which is coated with a heat resistant film and which is cut and scored as illustrated in FIG. 6. It will be understood that the container shown in the drawings is described and illustrated for the purpose of setting forth the presently preferred form of the invention and that the principles of the invention may be otherwise applied.

The tray 10, as illustrated in FIGS. 1 to 5, is fabricated from the cut and scored blank 12 which is shown in FIG. 6 with the face uppermost which will become the inside face in the set-up tray. In the form illustrated, the blank 12 is prepared from paperboard, of relatively light weight or gauge, which is coated or laminated with a suitable material to render it more resistant to damage when subject to high temperatures, particularly baking oven temperatures. The paperboard stock is of a gauge which will provide a predetermined degree of stiffness, so that, the fully formed tray or carton will retain its normal shape when filled with the product for processing. The illustrated material is provided with a coating of plastic film material which will increase its resistance to absorption of heat to the degree desired for withstanding baking oven temperatures and which will also permit heat sealing of the coated surface to the paperboard surface. A suitable treatment of paperboard stock to form the blank 12 is set forth in U.S. Pat. No. 3,904,104 granted Sept. 9, 1976 to William Paul Kane.

Figure 1:
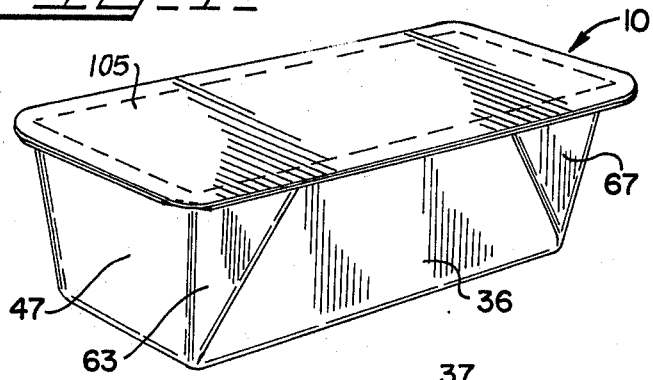
FIG. 1 is a perspective view of a tray-type container which embodies the principal features of the invention; the tray being shown with a top covering member in place.
Figure 4:
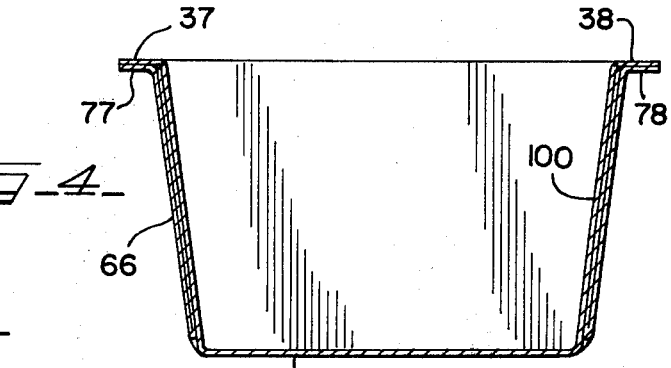
FIG. 4 is a cross-sectional view taken on line 4—4 of FIG. 2 to an enlarged scale.
Figure 2:
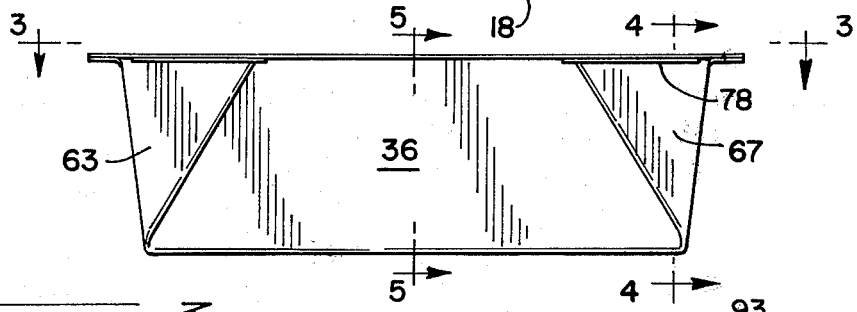
FIG. 2 is an elevational view of the one side of the tray container shown in FIG. 1.
Figure 3:
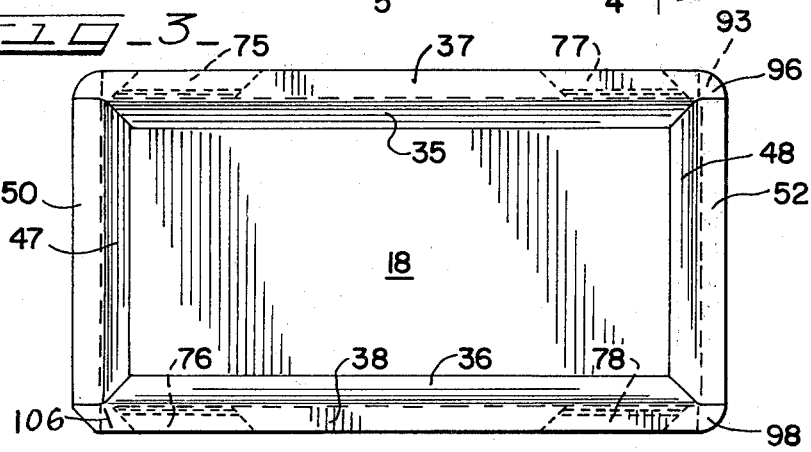
FIG. 3 is a plan view of the tray of FIG. 1 with the top covering member removed.

The blank 12, which is particularly designed to form a tray for processing a loaf of bread, that is, having a somewhat greater length than width, is in the form of a generally rectangular sheet of the foldable material with a substantially greater length than width. The blank is cut so that the grain is in the direction of the width or shortest dimension of the blank, as indicated by the arrow 13 in FIG. 6. The blank is cut and scored or creased, so that it is symmetrical about longitudinal and transverse center lines a—a and b—b. The blank is divided by parallel longitudinally extending, transversely spaced, hinge forming score or crease lines 14, 15 and parallel transversely extending, longitudinally spaced, hinge forming score or crease lines 16, 17 which define a bottom wall forming center panel 18 with its edges coinciding with the bottom edges of sidewall forming panel portions 20 and 22, and end wall forming panel portions 23 and 24. The side and end wall panel portions 20, 22 and 23, 24 are connected at the four corners of the blank by corner connecting web portions 25, 26, 27 and 28. The transverse score lines 16 and 17 are extended at their opposite ends on lines 30, 32, 33 and 34, respectively, the latter being on a slight angle or inclination in the direction of the opposite ends of the blank and defining the opposite ends of the sidewall panels 35 and 36. The sidewall panels 35 and 36 have relatively narrow flange forming edge reinforcing panel portions 37, 38 which extend along the free outer margins thereof and which are divided therefrom by combination cut and creased lines 40 and 42, the latter being parallel with and spaced outwardly of the score lines 14 and 15, respectively. The longitudinal score lines 14 and 15 are extended at their opposite ends on lines 43, 44 and 45, 46 which are at a slight angle or inclination in the direction of the opposite sides of the blank and which define the ends of end wall panels 47 and 48. The end wall panels 47 and 48 have outboard margins with relatively narrow edge reinforcing panel portions 50 and 52 which are divided therefrom by combination cut and creased lines 53 and 54, the latter being parallel with and spaced outwardly of the score lines 16 and 17, respectively. The corner connecting web panels 25, 26, 27, 28 are each divided by a center fold forming score line 55, 56, 57, 58 so as to form pairs of triangular web panels 60, 62: 63, 64: 65, 66 and 67, 68. The pair of web panels 60, 62 connect side and end wall panels 35 and 47 while the panels 63, 64 connect side and end wall panels 36, 47, at one end of the blank. At the other end of the blank panels 65, 66 connect side and end wall panels 35 and 48 while panels 67, 68 connect side and end wall panels 36 and 38. The outside edges 70, 72, 73, 74 of the corner web panels 60, 64, 65, 68 are cut on lines which are approximately normal to the score lines 30, 32, 33 34 and define the ends of the associated sidewall panels 35 and 36 so that each pair of these corner web panels may be folded into overlying relation and positioned along the outside faces of the associated sidewall panels 35, 36 with the top edge of each triangular web panel positioned only a small distance below the top edge of the side wall 35, 36. The corner web panels 62, 63 and 66, 67, which adjoin the end wall forming panels 47 and 48, have narrow edge flange forming panel portions 75, 76 and 77, 78 which are divided therefrom by combination cut and scored lines 80, 82 and 83, 84. The panel portions 75, 76 and 77, 78 will have a width somewhat less than the width of the associated flange forming panels 37, 38 and 50, 52 which permits these panels to be engaged beneath the opposite ends of the associated top flange forming panels 37, 38 on the sidewall forming panels 35 and 36 when the corner web panels are folded into overlying relation with and along the top outside margin of the associated sidewall panels 35 and 36. The flange forming panels 75, 76 and 77, 78 are cut at the ends adjoining panels 50 and 52 on lines 85, 86 and 87, 88 so as to leave these panels, 50 and 52, with small tabs 90, 92 and 93, 94 extending from opposite ends thereof. The flange forming panels 37 and 38 on the long length sidewall forming panels 35 and 36 are each extended at their opposite ends to provide integral corner connecting tabs 95 and 96 on the flange panel 37 and tabs 97 and 98 on the flange panel 38. The tabs 95, 96 and 97, 98 extend beyond transverse hinge fold lines 30, 32 and 33, 34 and are cut so as to overlie the end tabs 90, 92 and 93, 94 on the end flange members 50 and 52 when the tray is set up (FIGS. 2, 3, 4).

The combination cut and scored lines 40, 42 and 53, 54 and 80, 82, 83, 84 are formed by "skip cutting" or "cut scoring" the blank material, that is, by cutting on these lines closely spaced cuts of relatively small length which extend through the plastic film coating 100 (FIG. 5) but not through the paperboard with which the film forms a laminate for a purpose hereinafter set forth. The intervals between the small lengths cuts may or may not be creased, since the cuts will define the hinge fold line for the relatively light gauge paperboard as well as a means for relieving the tension in the film. The cut scoring on lines 80, 82, 83 and 84 may be on the outside face of the blank, that is, the face opposite the film 100 and the cuts may extend through the paperboard 102 and the film 100.

In setting up the tray 10 from the blank 12, the end wall panels 47 and 48 may be folded on the hinge lines 16 and 17 simultaneously with the folding of the sidewall panels 35 and 36 about the hinge lines 14 and 15. The corner connecting web structures 25, 26, and 27, 28 will fold with the end and sidewall panels with which they are integrally connected and the two halves of each such corner structure will fold upon themselves and about the hinge lines 30, 33 and 32, 34 with the folded panels being directed into overlying relation on the outside faces of the sidewall panels 35 and 36, leaving the small flange forming panels 75, 77 and 76, 78 with the coated or film side or face exposed for heat sealing to the outside faces of the end portions of the flange forming panels 37, 38 on the sidewalls 35, 36. The end wall flange portions 50 and 52 will be folded into outwardly directed flange position followed by folding of the flange portions 37, 38 so as to bring the flange end tabs 95, 96, 97, 98 and 90, 92, 93, 94 into overlying sealed relation.

In FIG. 5, the purpose in forming the cut scoring of the material on the lines 40, 42 and 53, 54 is illustrated. The plastic film material 100 and the paperboard material have sufficiently different shrinking and stretching characteristics when heated and cooled so that the sidewalls otherwise may be buckled due to this difference. This is undesirable. The cut scoring relieves or counteracts this to a substantial degree, so that the corner connecting web arrangement and the sidewall top flange formation is effective to prevent any substantial bowing in the associated sidewalls.

A separate cover member or lid 105 (FIG. 1) may be provided which may be applied with its margins adhesively secured to the flanges 37, 38, and 50, 52 so as to seal the contents in the tray. To facilitate removal of the lid by the consumer, a corner flange tab, for example, 96, may be cut or weakened, on the line 106, to enable the associated corner of the lid to be more firmly grasped and more easily torn loose so as to start the separation of the lid margins from the sidewall flanges.

What is claimed is:

1. A container in the form of a tray for processing and packaging a loaf of bread or similar bakery product, said tray being formed from a single sheet of paperboard having a heat sealable and heat resistant film coating with a greater shrinkage characteristic than the paperboard material under heating and cooling conditions, said tray comprising a bottom wall panel, integral upstanding sidewall panels, folded triangular webs joining the ends of adjacent sidewall panels, with pairs of said webs secured to the outside faces of oppositely disposed sidewall panels, said sidewall panels having outwardly directed narrow flange formations at the top edges thereof and said connecting triangular webs having a top flange formation adhesively secured to the bottom face of the top edge flange formation on the sidewall to which said triangular webs are secured and said sidewall panels having a line of skip-cutting at the top hinge edge thereof with the cuts severing the film material but not through the paperboard so as to reduce buckling in the sidewalls which would otherwise occur due to the difference in shrinkage of the film and the paperboard material when the tray is heated and allowed to cool.

2. A container in the form of a tray as set forth in claim 1 wherein the tray has substantially greater length than width and the webs of each pair thereof are disposed on opposite ends and on outside faces of the sidewall panels which extend lengthwise of the tray.

3. A container in the form of a tray as set forth in claim 2 wherein the tray is formed with the grain of the material extending transversely of the bottom and sidewall panels.

4. A container in the form of a tray as set forth in claim 1 wherein the folded triangular webs of each pair thereof are heat sealed.

5. A container in the form of a tray as set forth in claim 1 wherein the triangular webs extend the full depth of the tray at the corners and said webs are folded and heat sealed so as to form a rigid corner post formation.

6. A cut and scored blank of paperboard material which is coated with a plastic film having greater shrink characteristics than the paperboard, said blank being divided on longitudinally and transversely extending pairs of spaced parallel hinge score lines so as to provide an elongate rectangular center panel constituting a bottom wall forming panel for a tray container, and pairs of side and end wall forming panels, extending about the perimeter of said center panel, the corners of said blank being scored so as to form pairs of triangular corner connecting web panels, each pair of which is adapted to be folded upon itself and against the outside face of the longer sidewall forming panel from which it is separated by a hinge score line and narrow flange forming strip portions at the outermost margins of said side and end wall forming panels which are divided from said wall forming panels by skip cutting lines which sever the film coating material but not through the paperboard so as to minimize buckling in the wall forming panels which would otherwise occur upon oven processing due to the difference in shrink characteristics of the film and the paperboard.

* * * * *

UNITED STATES PATENT AND TRADEMARK OFFICE

CERTIFICATE OF CORRECTION

PATENT NO. : 4,308,985

DATED : January 5, 1982

INVENTOR(S) : William M. Brown
Guelfo A. Manizza

It is certified that error appears in the above-identified patent and that said Letters Patent are hereby corrected as shown below:

Column 4, line 1, delete "38" and insert -- 48 --.

Signed and Sealed this

*Thirteenth* Day of *April 1982*

[SEAL]

*Attest:*

GERALD J. MOSSINGHOFF

*Attesting Officer*

*Commissioner of Patents and Trademarks*